US011742120B2

(12) United States Patent
Liu et al.

(10) Patent No.: US 11,742,120 B2
(45) Date of Patent: Aug. 29, 2023

(54) TWO-STEP DIFFUSION METHOD FOR PREPARING HIGH-PERFORMANCE DUAL-MAIN-PHASE SINTERED MISCHMETAL-IRON-BORON MAGNET

(71) Applicant: BEIJING UNIVERSITY OF TECHNOLOGY, Beijing (CN)

(72) Inventors: Weiqiang Liu, Beijing (CN); Hao Chen, Beijing (CN); Ming Yue, Beijing (CN); Zhi Li, Beijing (CN); Yantao Yin, Beijing (CN); Yuqing Li, Beijing (CN); Hongguo Zhang, Beijing (CN)

(73) Assignee: BEIJING UNIVERSITY OF TECHNOLOGY, Beijing (CN)

( * ) Notice: Subject to any disclaimer, the term of this patent is extended or adjusted under 35 U.S.C. 154(b) by 111 days.

(21) Appl. No.: 17/520,452

(22) Filed: Nov. 5, 2021

(65) Prior Publication Data

US 2022/0059262 A1 Feb. 24, 2022

Related U.S. Application Data

(63) Continuation of application No. PCT/CN2020/103272, filed on Jul. 21, 2020.

(30) Foreign Application Priority Data

Nov. 13, 2019 (CN) ..... 201911111736.5

(51) Int. Cl.
*H01F 1/057* (2006.01)
*H01F 1/053* (2006.01)
(Continued)

(52) U.S. Cl.
CPC ..... *H01F 1/0573* (2013.01); *B22F 9/023* (2013.01); *B22F 9/04* (2013.01); *H01F 1/0536* (2013.01);
(Continued)

(58) Field of Classification Search
CPC .... H01F 1/0536; H01F 1/0553; H01F 1/0555; H01F 1/0057; H01F 1/0573;
(Continued)

(56) References Cited

U.S. PATENT DOCUMENTS

2008/0286595 A1* 11/2008 Yoshimura ..... H01F 41/0293 428/548
2010/0182112 A1* 7/2010 Nagasaki ..... F16K 31/0675 335/261
(Continued)

FOREIGN PATENT DOCUMENTS

CN 102640238 A 8/2012
CN 104715876 A 6/2015
(Continued)

OTHER PUBLICATIONS

Gao et al, "High coercivity Nd—Fe—B magnet with low Tb concentration by combined diffusion," 2021. Journal of Magnetism and Magnetic Materials, vol. 528 (Year: 2021).*
(Continued)

*Primary Examiner* — Keith Walker
*Assistant Examiner* — Benjamin C Anderson
(74) *Attorney, Agent, or Firm* — J.C. Patents

(57) ABSTRACT

A two-step diffusion method for preparing high-performance dual-main-phase sintered mischmetal-iron-boron magnet belongs to the preparing technical field of rare earth permanent magnet materials. The compositions of the two main phase alloys are RE-Fe—B (RE is Nd or Pr) and (Nd, MM)-Fe—B (MM is mischmetal), respectively. First, PrHoFe strip-casting alloy is used as a diffusion source. Next, a PrHo-rich layer is uniformly coated on the surface of (Nd, MM)-Fe—B hydrogen decrepitation powders. The higher anisotropic fields of $Pr_2Fe_{14}B$ and $Ho_2Fe_{14}B$ are used to improve the coercivity. Then, the ZrCu strip-casting alloy
(Continued)

is used as a diffusion source. A Zr-rich layer is uniformly coated on the surface of the powders after the first-step diffusion, which prevents the growth of the MM-rich main phase grains during the sintering process and the inter-diffusion between the two main phases, thus obtaining high coercivity.

3 Claims, 1 Drawing Sheet

(51) Int. Cl.

| | |
|---|---|
| ***H01F 1/055*** | (2006.01) |
| ***H01F 7/02*** | (2006.01) |
| ***H01F 41/02*** | (2006.01) |
| ***B22F 9/04*** | (2006.01) |
| ***B22F 9/02*** | (2006.01) |

(52) U.S. Cl.
CPC ..... *H01F 1/0551* (2013.01); *H01F 1/0553* (2013.01); *H01F 1/0557* (2013.01); *H01F 1/0577* (2013.01); *H01F 7/021* (2013.01); *H01F 41/0266* (2013.01); *H01F 41/0273* (2013.01); *H01F 41/0293* (2013.01)

(58) Field of Classification Search
CPC .. H01F 1/0575; H01F 1/0577; H01F 41/0253; H01F 41/0266; H01F 41/0273; H01F 41/0293; B22F 9/023; B22F 9/04; B22F 2009/044; B22F 2009/048
See application file for complete search history.

(56) References Cited

U.S. PATENT DOCUMENTS

| | | | | |
|---|---|---|---|---|
| 2011/0205006 | A1* | 8/2011 | Odaka | C22C 33/0257 335/302 |
| 2012/0114844 | A1* | 5/2012 | Odaka | C22C 38/06 427/127 |
| 2013/0038159 | A1 | 2/2013 | Liu | |
| 2014/0375404 | A1* | 12/2014 | Kuniyoshi | H01F 7/02 427/127 |

FOREIGN PATENT DOCUMENTS

| | | | | |
|---|---|---|---|---|
| CN | 107665769 | A | | 2/2018 |
| CN | 107731437 | A | | 2/2018 |
| CN | 109550945 | A | * | 4/2019 |
| CN | 109550945 | A | | 4/2019 |
| CN | 109872871 | A | | 6/2019 |
| CN | 110047636 | A | | 7/2019 |
| CN | 110853854 | A | | 2/2020 |
| CN | 114038641 | A | * | 2/2022 |
| CN | 114464443 | A | * | 5/2022 |

OTHER PUBLICATIONS

First Search Report of CN201911111736.5.
Second Search Report of CN201911111736.5.
International Search Report of PCT/CN2020/103272.
First Office Action of CN201911111736.5.

* cited by examiner

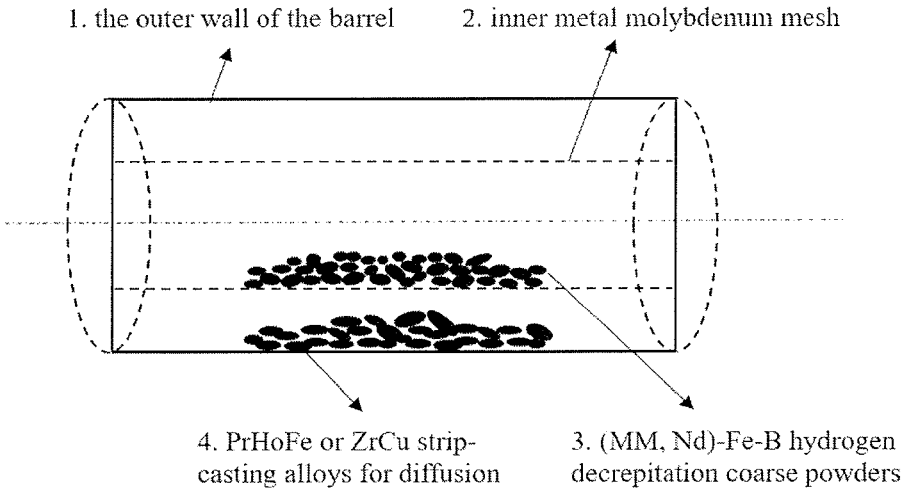
1. the outer wall of the barrel
2. inner metal molybdenum mesh
4. PrHoFe or ZrCu strip-casting alloys for diffusion
3. (MM, Nd)-Fe-B hydrogen decrepitation coarse powders

TWO-STEP DIFFUSION METHOD FOR PREPARING HIGH-PERFORMANCE DUAL-MAIN-PHASE SINTERED MISCHMETAL-IRON-BORON MAGNET

CROSS-REFERENCE TO RELATED APPLICATION

This application is a continuation application of international application PCT/CN2020/103272, filed on Jul. 21, 2020, which claims priority to Chinese Patent Application No. 201911111736.5, filed on Nov. 13, 2019. The above identified applications are hereby incorporated by reference in their entirety and made a part of this specification.

TECHNICAL FIELD

The invention provides a two-step diffusion method for preparing high-performance dual-main-phase sintered mischmetal-iron-boron magnet, belonging to the preparing technical field of rare earth permanent magnet materials.

BACKGROUND

As the third generation of rare earth permanent magnet, sintered NdFeB magnet has been widely used in electronics, electric machinery, aerospace, transportation, and other areas because of its excellent comprehensive magnetic properties. As a result, it has become one of the most important basic functional materials. However, with the increasing demand for sintered NdFeB magnets, a large number of rare earth elements such as Pr, Nd, Dy, and Tb are consumed, which also leads to the rise of their prices. Therefore, using partly Mischmetal to replace the expensive Nd and Pr to prepare magnets can reduce costs, achieve the comprehensive utilization of rare earth (RE) resources and protect the environment. Mischmetal (E) is composed of La, Ce, Pr, and Nd, mined from rare earth raw ore. The intrinsic magnetic properties of $La_2Fe_{14}B$ and $Ce_2Fe_{14}B$ are much lower than those of Pr and Nd. Therefore, when the mischmetal is used to prepare the magnet, the magnet's performance will deteriorate, significantly the coercivity will be seriously reduced.

The grain refinement, grain boundary restructure, and grain boundary diffusion technologies are the main methods to improve NdFeB magnets' coercivity. At present, the most widespread application is grain boundary diffusion technology, which mainly diffuses heavy rare earth Dy, Tb, or low melting point rare earth alloys in sintered magnets. However, during the diffusion process, the diffusion depth of heavy rare earth elements or low melting point alloys in the bulk magnet's matrix is limited, making the grain boundary diffusion technology have certain defects. Therefore, realizing the element diffusion on the powder's surface through specific techniques has a better effect on coercivity enhancement. At present, the reports mainly focus on the diffusion of heavy rare earth elements such as Dy and Tb on jet milling powders. They include the thermal resistance evaporation deposition method (such as patent 201710624106.2), magnetron sputtering method (such as patent 201110242847.7), and rotary evaporation diffusion method (such as patent 201710852677.1). However, these methods are aiming at the diffusion of jet milling powders. Because the particle size of jet milling powders is small, it will cause severe oxidation and further influence the magnet's properties. At the same time, the cost of diffusing heavy rare earth elements such as Dy and Tb is too high. In addition, the thermal resistance evaporation deposition method and magnetron sputtering method have higher requirements for the equipment. Therefore, it is not easy to control the cost and realize industrialization. However, the long-distance between the diffusion source and the jet milling powders and the severe agglomeration of jet milling powders during heating for the rotary evaporation diffusion method leads to a poor diffusion effect and limits the magnet's performance enhancement.

We use the double alloy method to prepare the high-performance mischmetal magnets. However, the main phase of (E, Nd)—Fe—B with a higher amount of mischmetal substitution has poor performance. Especially, the decrease of the anisotropy field by the substitution of mischmetal leads the low coercivity. At the same time, the grain is also more likely to grow up during sintering. The most important is that the binary-main-phase magnet will have serious inter-diffusion during sintering and heat treatment, which leads to the severe deterioration of the magnetic performance. Therefore, the invention first carries out a two-step diffusion treatment on (E, Nd)—Fe—B hydrogen decrepitation powders with a high substitution amount of mischmetal. In the first-step diffusion, PrHoFe strip-casting alloy is used as a diffusion source. A PrHo-rich layer is uniformly coated on the surface of hydrogen decrepitation powders. The $Pr_2Fe_{14}B$ and $Ho_2Fe_{14}B$ phases with higher anisotropic fields can improve the coercivity. In the second-step diffusion, the ZrCu strip-casting alloy is used as a diffusion source. A Zr-rich layer is uniformly coated on the surface of the powders after the first-step diffusion, which prevents the growth of the E main phase grains during the sintering process and the inter-diffusion between the two main phases, thus obtains high coercivity. The magnets prepared by this method are cost-effective and are expected to replace medium and high-grade magnets.

DISCLOSURE OF THE INVENTION

The invention provides a two-step diffusion method for preparing high-performance dual-main-phase sintered mischmetal-iron-boron magnet. The purpose is to improve the magnetic properties of (E, Nd)—Fe—B hydrogen decrepitation powders with poor properties by two-step diffusion treatment and double alloy method, then obtain low-cost and high-performance magnets.

A two-step diffusion method for preparing high-performance dual-main-phase sintered mischmetal-iron-boron magnet comprises the $Pr/Nd_2Fe_{14}B$ main phase (A) and the $(E, Nd)_2Fe_{14}B$ main phase (B). The hydrogen decrepitation coarse powder of main phase B is subjected to two-step rotating diffusion treatments, then mixed with the hydrogen decrepitation coarse powder of the main phase A. The mass ratio of the main phases A and B is 1:9-5:5, and the sum is 10.

The nominal composition of the main phase A is $Pr/Nd_xFe_{100-x-y-z}M_yB_z$ (wt. %), and the nominal composition of the main phase B is $[E_aNd_{1-a}]_xFe_{100-x-y-z}M_yB_z$ (wt. %). E is mischmetal, in which the mass percent of each component is Ce: 48-58%, La: 20-30%, Pr: 4-6%, and Nd: 15-17%. M is one or more of Nb, Ti, V, Co, Cr, Mn, Ni, Zr, Ga, Ag, Ta, Al, Au, Pb, Cu, Si, x, x1, y, z satisfies the following relationships: $0 \le a \le 1$, $25 \le x \le 35$, $0.5 \le y \le 3$, $0.3 \le z \le 1.5$.

A two-step diffusion method for preparing high-performance dual-main-phase sintered mischmetal-iron-boron magnet comprises the following steps:

(1) According to the main phase A with the nominal composition of $Pr/Nd_xFe_{100-x-y-z}M_y B_z$, and the main phase B with the nominal composition of $[E_aNd_{1-a}]_x Fe_{100-x-y-z}$ $M_yB_z$, praseodymium, mischmetal (E), other metals (M), neodymium, iron, and iron boron alloy are selected and put into the crucible. After drying under vacuum, the furnace is filled with argon.

The mixed metals are smelted and then poured on a rotating water-cooled copper roller with a rotation speed of 1-4 m/s. The A and B strip-casting alloys with a thickness of 180-400 μm are obtained, respectively.

(2) The PrHoFe alloy and ZrCu alloy are prepared into strip-casting alloys using a vacuum induction rapid-quench furnace, respectively. Then they are roughly broken into square pieces with the size of (0.5-1.5) cm*(0.5-1.5) cm.

(3) Wherein the A and B strip-casting alloys of step (1) are broken by hydrogen decrepitation, respectively, and the coarsely crushed powders are obtained after dehydrogenation.

(4) Wherein the B hydrogen decrepitation coarse powders of step (3) and the PrHoFe strip-casting alloys of step (2) are placed in the inner and outer cavities of a coaxial double-layers circular barrel for the first step diffusion treatment, respectively. The mass ratio of the two kinds of alloys is 2:1 to 1:2. A molybdenum mesh separates the inner cavity and the outer cavity. The first-step diffusion coarse powders are obtained by diffusion heat treatment at a certain speed (1-10 r/min) and 500-700° C. for 3-6 h in a rotary heat treatment furnace. The external shell of the coaxial double-layers circular barrel is made of solid material plates. The coaxial inner layer is a molybdenum mesh cylinder. The annular cavity structure between the molybdenum mesh cylinder and the external shell of the barrel is an outer cavity. The cavity in the molybdenum mesh cylinder is an inner cavity. The mesh diameter of the molybdenum mesh is less than 5 μm.

(5) Wherein the first-step diffusion coarse powders of step (4) and the broken ZrCu strip-casting alloys of step (2) are placed in the inner and outer cavities of the coaxial double-layer circular barrel for the second-step diffusion treatment to obtain the second-step diffusion coarse powders, respectively. The mass ratio of the two kinds of alloys is 2:1 to 1:2. The diffusion heat treatment is carried out in a rotary heat treatment furnace at a certain speed of 1-10 r/min and 800-950° C. for 2-5 h. The rotary heat treatment furnace is connected with a glove box filled with inert gas to protect the raw materials during moving in and out of the furnace in the glove box.

(6) Wherein the A hydrogen decrepitation coarse powders of step (3) are mixed with the second-step diffusion coarse powder after two-step diffusion treatment of step (5) to make the mass ratio of main phases A and B between 1:9 and 5:5. The powder with a fine diameter of 1-5 μm is obtained by jet milling after adding 0.01-5 wt. % lubricant and 0.01-5 wt. % antioxidant. The above-mentioned mass percentage is the sum of the mass percentage of the A hydrogen decrepitation coarse powder of step (3) and the second-step diffusion coarse powders after two-step diffusion treatment of step (5).

(7) Wherein the fine powders of step (6) adding 0.01-5 wt. % lubricant and 0.01-5 wt. % antioxidant again are mixed well, then aligned and compacted under a magnetic field of 1.5-2.0 T in an inert gas to obtain the compacts. The compacts are vacuum-encapsulated and subjected to cold isostatic pressing. The above-mentioned mass percentage is the mass percentage of the fine powders of step (6).

(8) Wherein the green compacts of step (7) are put into a vacuum sintering furnace for sintering at 980-1080° C. for 1-4 h and then cooled by argon air. To restrain the inter-diffusion between the two phases, the binary-main-phase magnets are only annealed at low temperature at 400-600° C. for 2-5 h.

The composition and mass percentage of the PrHoFe alloy are: the mass fraction of Pr is 40-80%, the mass fraction of Ho is 10-40%, and the mass fraction of Fe is 10-20%. The composition and mass percentage of the ZrCu alloy are: the mass fraction of Zr is 35-65%, the mass fraction of Cu is 35-65%.

The lubricants and antioxidants are traditional in the field.

Compared with the prior technology, the invention has the following advantages:

(1) Using mischmetal to prepare magnets can reduce costs and achieve the comprehensive utilization of rare earth resources and protect the environment.

(2) The invention adopts a two-step rotating diffusion method to diffuse PrHoFe alloy and ZrCu alloy to the hydrogen decrepitation coarse powders containing mischmetal. A PrHo-rich layer can be uniformly coated on the surface of the powders, form the $Pr_2Fe_{14}B$ and $Ho_2Fe_{14}B$ phases with higher anisotropic fields, which can improve the coercivity. On the other hand, a melting point Zr-rich alloy layer can be uniformly coated on the surface of the powders, which can prevent the growth of E-rich grains during the sintering process and inhibit the inter-diffusion with the other main phase $Pr/Nd_2Fe_{14}B$. It is also beneficial to obtain high coercivity.

(3) The invention adopts (E, Nd)—Fe—B hydrogen decrepitation coarse powders prepared by two-step rotating diffusion and Pr/Nd—Fe—B hydrogen decrepitation coarse powders to fabricate binary-main-phase magnet. It solves the problems of the low anisotropy field of (E, Nd)—Fe—B alloy, the non-uniform grain size of two phases, and the inter-diffusion of two main phase grains during sintering and heat treatment. Therefore, the magnetic properties of the final binary-main-phase magnet are improved obviously.

(4) The invention adopts a rotating diffusion method to diffuse PrHoFe alloy and ZrCu alloy on the hydrogen decrepitation coarse powders containing mischmetal. As a result, it can realize mass production, improve production efficiency, and simply operate, which is extremely easy to realize industrialized production. In addition, the PrHoFe and ZrCu strip-casting alloys can also be reused, significantly reduce production costs.

BRIEF DESCRIPTION OF THE DRAWINGS

FIG. 1 is a schematic diagram of a double-layer circular barrel used for diffusion in the invention.

In the FIGURE: 1—the outer wall of the barrel, 2—inner metal molybdenum mesh, 3—(E,Nd)—Fe—B hydrogen decrepitation coarse powders, 4—PrHoFe or ZrCu strip-casting alloys for diffusion.

DETAILED DESCRIPTION OF THE PREFERRED EMBODIMENTS

The following examples describe this disclosure, but do not limit the coverage of the disclosure.

Comparative Example 1

The nominal composition of main phase A was $Pr_{31.5}Fe_{ba1}Al_{0.4}Cu_{0.2}Co_1Ga_{0.2}Zr_{0.22}B_{0.98}$ (wt. %), and the nominal composition of main phase B was $(Nd_{0.5}E_{0.5})_{31.5}Fe_{ba1}Al_{0.4}Cu_{0.2}Co_1Ga_{0.2}Zr_{0.22}B_{0.98}$ (wt. %) (E including about 27.49 wt. % La, 53.93 wt. % Ce, 1.86 wt. % Pr and 16.72 wt. % Nd). The rotation speed of the copper roller was 1.25 m/s. The A and B strip-casting alloys with a thickness of 210 μm were obtained.

The A and B strip-casting alloys were broken by hydrogen decrepitation, respectively. The coarsely crushed powders were obtained after dehydrogenation. The powders of A and B with the mean diameter ($X_{50}$) of 2.10 μm were obtained by jet milling after adding 0.05 wt. % lubricant and 0.1 wt. % antioxidant.

In the glove box, the A and B jet milling powders added 0.1 wt. % lubricant and 0.2 wt. % antioxidant were mixed evenly, respectively. Next, the A and B magnetic powders were aligned and compacted under a magnetic field of 2.0 T in inert gas. The A and B green compacts were vacuum packaged for isostatic pressing and then placed in a vacuum sintering furnace for sintering at 1060° C. and 1050° C. for 2 h and then cooled by argon respectively.

Subsequently, two-stage heat treatments were carried out. The first-stage tempering temperature was 900° C. for 3 h; the second-stage tempering temperature was 450° C. for 4 h.

The magnetic properties of the A and B magnets were measured by the permanent magnetic measurement system (BH tester), the results were as follows:

Magnet A: $B_r$=13.69 kG, $H_{cj}$=20.18 kOe, $(BH)_{max}$=45.72 MGOe, $H_k/H_{cj}$=97.7%.

Magnet B: $B_r$=12.29 kG, $H_{cj}$=9.02 kOe, $(BH)_{max}$=36.86 MGOe, $H_k/H_{cj}$=92.0%.

Comparative Example 2

The nominal composition of main phase A was $Pr_{31.5}Fe_{ba1}Al_{0.4}Cu_{0.2}Co_1Ga_{0.2}Zr_{0.22}B_{0.98}$ (wt. %), and the nominal composition of main phase B was $(Nd_{0.5}E_{0.5})_{31.5}Fe_{ba1}Al_{0.4}Cu_{0.2}Co_1Ga_{0.2}Zr_{0.22}B_{0.98}$ (wt. %) (E including about 27.49 wt. % La, 53.93 wt. % Ce, 1.86 wt. % Pr and 16.72 wt. % Nd). The rotation speed of the copper roller was 1.25 m/s. The A and B strip-casting alloys of with a thickness of 210 μm were obtained.

The A and B strip-casting alloys were broken by hydrogen decrepitation, respectively. The coarsely crushed powders were obtained after dehydrogenation.

The A and B hydrogen decrepitation coarse powders were mixed with the mass ratios of 1:9 and 3:7. And the powders of two components C and D with a mean diameter ($X_{50}$) of 2.10 μm were obtained by jet milling after adding 0.05 wt. % lubricant and 0.1 wt. % antioxidant.

In the glove box, the C and D jet milling powders added 0.1 wt. % lubricant and 0.2 wt. % antioxidant were mixed evenly, respectively. Next, the C and D magnetic powders were aligned and compacted under a magnetic field of 2.0 T in inert gas. The C and D green compacts were vacuum packaged for isostatic pressing and then placed in a vacuum sintering furnace for sintering at 1050° C. for 2 h and then cooled by argon. Subsequently, only low-temperature heat treatment was carried out, and the tempering temperature was 450° C. for 4 h.

The magnetic properties of the C and D magnets were measured by the permanent magnetic measurement system (BH tester), the results were as follows:

Binary-main-phase magnet C: $B_r$=12.53 kG, $H_{cj}$=9.53 kOe, $(BH)_{max}$=38.11 MGOe, $H_k/H_{cj}$=93.4%.

Binary-main-phase magnet D: $B_r$=12.68 kG, $H_{cj}$=12.05 kOe, $(BH)_{max}$=39.50 MGOe, $H_k/H_{cj}$=94.2%.

Example 1

The nominal composition of main phase A was $Pr_{31.5}Fe_{ba1}Al_{0.4}Cu_{0.2}Co_1Ga_{0.2}Zr_{0.22}B_{0.98}$ (wt. %), and the nominal composition of main phase B was $(Nd_{0.5}E_{0.5})_{31.5}Fe_{ba1}Al_{0.4}Cu_{0.2}Co_1Ga_{0.2}Zr_{0.22}B_{0.98}$ (wt. %) (E including about 27.49 wt. % La, 53.93 wt. % Ce, 1.86 wt. % Pr and 16.72 wt. % Nd). The rotation speed of the copper roller was 1.25 m/s. The A and B strip-casting alloys with a thickness of 210 μm were obtained.

The PrHoFe alloy and ZrCu alloy were prepared into strip-casting alloys using a vacuum induction rapid-setting furnace, respectively. Then they were roughly broken into 1 cm*1 cm square pieces.

The A and B strip-casting alloys were broken by hydrogen decrepitation, respectively, and the coarsely crushed powders were obtained after dehydrogenation.

The B hydrogen decrepitation coarse powders and the crushed $Pr_{65}Ho_{20}Fe_{15}$ strip-casting alloys were placed in the inner and outer cavities of a coaxial double-layer circular barrel with a mass ratio of 1:1, respectively. A metal molybdenum mesh separated the inner and outer cavities of the barrel with a diameter less than 5 μm. The first-step diffusion heat treatment was carried out in a rotary heat treatment furnace with a speed of 5 r/min at 630° C. for 4 h. Then, the hydrogen decrepitation coarse powder obtained by the first-step diffusion and the crushed $Zr_{55}Cu_{45}$ strip-casting alloys were put into a rotary heat treatment furnace with a mass ratio of 1:1. And the second-step diffusion heat treatment was carried out at 885° C. for 3 h with a speed of 5 r/min. In the above heat treatment process, the furnace was first evacuated to $5\times10^{-3}$ Pa, and then filled with argon to 65 kPa. The subsequent experiment was carried out in an argon protective atmosphere. The rotary heat treatment furnace is connected with a glove box filled with inert gas to protect the raw materials during moving in and out of the furnace in the glove box.

The A and diffused B hydrogen decrepitation coarse powders were mixed with the mass ratios of 1:9 and 3:7. And the powders of two components C1 and D1 with a mean diameter ($X_{50}$) of 2.10 μm were obtained by jet milling after adding 0.05 wt. % lubricant and 0.1 wt. % antioxidant.

In the glove box, the C1 and D1 jet milling powders added 0.1 wt. % lubricant and 0.2 wt. % antioxidant were mixed evenly, respectively. Next, the C1 and D1 magnetic powders were aligned and compacted under a magnetic field of 2.0 T in inert gas. The C1 and D1 green compacts were vacuum packaged for isostatic pressing and then placed in a vacuum sintering furnace for sintering at 1050° C. for 2 h and then cooled by argon. Subsequently, only low-temperature heat treatment was carried out, the tempering temperature was 450° C. for 4 h.

The magnetic properties of the C1 and D1 magnets were measured by the permanent magnetic measurement system (BH tester), the results were as follows:

Binary-main-phase magnet C1: $B_r$=12.65 kG, $H_{cj}$=14.87 kOe, $(BH)_{max}$=39.76 MGOe, $H_k/H_{cj}$=96.7%.

Binary-main-phase magnet D1: $B_r$=12.92 kG, $H_{cj}$=16.95 kOe, $(BH)_{max}$=41.31 MGOe, $H_k/H_{cj}$=96.5%.

Example 2

The nominal composition of main phase A was $Pr_{31.5}Fe_{ba1}Al_{0.4}Cu_{0.2}Co_1Ga_{0.2}Zr_{0.22}B_{0.98}$ (wt. %), and the nominal composition of main phase B was $(Nd_{0.5}E_{0.5})_{31.5}Fe_{ba1}Al_{0.4}Cu_{0.2}Co_1Ga_{0.2}Zr_{0.22}B_{0.98}$ (wt. %) (E including about 27.49 wt. % La, 53.93 wt. % Ce, 1.86 wt. % Pr and 16.72 wt. % Nd). The rotation speed of the copper roller was 1.25 m/s. The A and B strip-casting alloys with a thickness of 210 μm were obtained. The PrHoFe alloy and ZrCu alloy were prepared into strip-casting alloys using a vacuum induction rapid-setting furnace, respectively. Then they were roughly broken into 1 cm*1 cm square pieces.

The A and B strip-casting alloys were broken by hydrogen decrepitation, respectively, and the coarsely crushed powders were obtained after dehydrogenation.

The B hydrogen decrepitation coarse powders and the crushed $Pr_{65}Ho_{20}Fe_{15}$ strip-casting alloys were placed in the inner and outer cavities of a coaxial double-layer circular barrel with a mass ratio of 1:1, respectively. A metal molybdenum mesh separated the inner and outer cavities of the barrel with a diameter less than 5 μm. The first-step diffusion heat treatment was carried out in a rotary heat treatment furnace with a speed of 5 r/min at 630° C. for 4 h. Then, the hydrogen decrepitation coarse powder obtained by the first-step diffusion and the crushed $Zr_{55}Cu_{45}$ strip-casting alloys were put into a rotary heat treatment furnace with a mass ratio of 1:1. And the second-step diffusion heat treatment was carried out at 915° C. for 3 h with a speed of 5 r/min. In the above heat treatment process, the furnace was first evacuated to $5\times10^{-3}$ Pa, and then filled with argon to 65 kPa. The subsequent experiment was carried out in an argon protective atmosphere. The rotary heat treatment furnace is connected with a glove box filled with inert gas to protect the raw materials during moving in and out of the furnace in the glove box.

The A and diffused B hydrogen decrepitation coarse powders were mixed with the mass ratios of 1:9 and 3:7. And the powders of two components C2 and D2 with a mean diameter ($X_{50}$) of 2.10 μm were obtained by jet milling after adding 0.05 wt. % lubricant and 0.1 wt. % antioxidant.

In the glove box, the C2 and D2 jet milling powders added 0.1 wt. % lubricant and 0.2 wt. % antioxidant were mixed evenly, respectively. Next, the C2 and D2 magnetic powders were aligned and compacted under a magnetic field of 2.0 T in inert gas. The C2 and D2 green compacts were vacuum packaged for isostatic pressing and then placed in a vacuum sintering furnace for sintering at 1050° C. for 2 h and then cooled by argon. Subsequently, only low-temperature heat treatment was carried out, the tempering temperature was 450° C. for 4 h.

The magnetic properties of the C2 and D2 magnets were measured by the permanent magnetic measurement system (BH tester), the results were as follows:

Binary-main-phase magnet C2: $B_r$=12.71 kG, $H_{cj}$=14.89 kOe, $(BH)_{max}$=39.92 MGOe, $H_k/H_{cj}$=96.3%.

Binary-main-phase magnet D2: $B_r$=12.94 kG, $H_{cj}$=17.06 kOe, $(BH)_{max}$=41.57 MGOe, $H_k/H_{cj}$=96.4%.

Example 3

The nominal composition of main phase A was $Pr_{31.5}Fe_{ba1}Al_{0.4}Cu_{0.2}Co_1Ga_{0.2}Zr_{0.22}B_{0.98}$ (wt. %), and the nominal composition of main phase B was $(Nd_{0.5}E_{0.5})_{31.5}Fe_{ba1}Al_{0.4}Cu_{0.2}Co_1Ga_{0.2}Zr_{0.22}B_{0.98}$ (wt. %) (E including about 27.49 wt. % La, 53.93 wt. % Ce, 1.86 wt. % Pr and 16.72 wt. % Nd). The rotation speed of the copper roller was 1.25 m/s. The A and B strip-casting alloys with a thickness of 210 μm were obtained.

The PrHoFe alloy and ZrCu alloy were prepared into strip-casting alloys using a vacuum induction rapid-setting furnace, respectively. Then they were roughly broken into 1 cm*1 cm square pieces.

The A and B strip-casting alloys were broken by hydrogen decrepitation, respectively, and the coarsely crushed powders were obtained after dehydrogenation.

The B hydrogen decrepitation coarse powders and the crushed $Pr_{65}Ho_{20}Fe_{15}$ strip-casting alloys were placed in the inner and outer cavities of a coaxial double-layer circular barrel with a mass ratio of 1:1, respectively. A metal molybdenum mesh separated the inner and outer cavities of the barrel with a diameter less than 5 μm. The first-step diffusion heat treatment was carried out in a rotary heat treatment furnace with a speed of 5 r/min at 630° C. for 4 h. Then, the hydrogen decrepitation coarse powder obtained by the first-step diffusion and the crushed $Zr_{55}Cu_{45}$ strip-casting alloys were put into a rotary heat treatment furnace with a mass ratio of 1:1. And the second-step diffusion heat treatment was carried out at 915° C. for 3 h with a speed of 10 r/min. In the above heat treatment process, the furnace was first evacuated to $5\times10^{-3}$ Pa, and then filled with argon to 65 kPa. The subsequent experiment was carried out in an argon protective atmosphere. The rotary heat treatment furnace is connected with a glove box filled with inert gas to protect the raw materials during moving in and out of the furnace in the glove box.

The A and diffused B hydrogen decrepitation coarse powders were mixed with the mass ratios of 1:9 and 3:7. And the powders of two components C3 and D3 with a mean diameter ($X_{50}$) of 2.10 μm were obtained by jet milling after adding 0.05 wt. % lubricant and 0.1 wt. % antioxidant.

In the glove box, the C3 and D3 jet milling powders added 0.1 wt. % lubricant and 0.2 wt. % antioxidant were mixed evenly, respectively. Next, the C3 and D3 magnetic powders were aligned and compacted under a magnetic field of 2.0 T in inert gas. The C3 and D3 green compacts were vacuum packaged for isostatic pressing and then placed in a vacuum sintering furnace for sintering at 1050° C. for 2 h and then cooled by argon. Subsequently, only low-temperature heat treatment was carried out, the tempering temperature was 450° C. for 4 h.

The magnetic properties of the C3 and D3 magnets were measured by the permanent magnetic measurement system (BH tester), the results were as follows:

Binary-main-phase magnet C3: $B_r$=12.76 kG, $H_{cj}$=15.04 kOe, $(BH)_{max}$=40.13 MGOe, $H_k/H_{cj}$=97.3%.

Binary-main-phase magnet D3: $B_r$=13.03 kG, $H_{cj}$=17.31 kOe, $(BH)_{max}$=42.05 MGOe, $H_k/H_{cj}$=97.8%.

The lubricants used in all the above comparative examples and examples are conventional in the field, and the antioxidant is conventional in the field.

TABLE 1

The $B_r$, $H_{cj}$, $(BH)_{max}$, and $H_k/H_{cj}$ of the magnets in the comparative examples and examples.

| | | $B_r$ (kG) | $H_{cj}$ (kOe) | $(BH)_{max}$ (MGOe) | $H_k/H_{cj}$ (%) |
|---|---|---|---|---|---|
| Comparative Example 1 | Magnet A | 13.69 | 20.18 | 45.72 | 97.7 |
| | Magnet B | 12.29 | 9.02 | 36.86 | 92.0 |
| Comparative Example 1 | BMP magnet C | 12.53 | 9.53 | 38.11 | 93.4 |
| | BMP magnet D | 12.68 | 12.05 | 39.50 | 94.2 |
| Examples 1 | Powder diffusion BMP magnet C1 | 12.65 | 14.87 | 39.76 | 96.7 |
| | Powder diffusion BMP magnet D1 | 12.92 | 16.95 | 41.31 | 96.5 |
| Examples 2 | Powder diffusion BMP magnet C2 | 12.71 | 14.89 | 39.92 | 96.3 |
| | Powder diffusion BMP magnet D2 | 12.94 | 17.06 | 41.57 | 96.4 |
| Examples 3 | Powder diffusion BMP magnet C3 | 12.76 | 15.04 | 40.13 | 97.3 |
| | Powder diffusion BMP magnet D3 | 13.03 | 17.31 | 42.05 | 97.8 |

The invention claimed is:

1. A two-step diffusion method for preparing high-performance dual-main-phase sintered mischmetal-iron-boron magnet, wherein the high-performance dual-main-phase sintered mischmetal-iron-boron magnet comprises a $Pr/Nd_2Fe_{14}B$ main phase A and a $(E, Nd)_2Fe_{14}B$ main phase B, hydrogen decrepitation coarse powders of the main phase B is subjected to two-step rotating diffusion treatment, then mixed with hydrogen decrepitation coarse powders of the main phase A, a mass ratio of the main phase A to the main phase B is 1:9-5:5 with the sum being 10;

wherein nominal composition of the main phase A is $Pr/Nd_xFe_{100-x-y-z}M_yB_z$ (wt. %), and nominal composition of the main phase B is $[E_aNd_{1-a}]_xFe_{100-x-y-z}M_yB_z$ (wt. %), where E is mischmetal, and mass percent of each component is Ce: 48-58%, La: 20-30%, Pr: 4-6%, and Nd: 15-17%; M is one or more of Nb, Ti, V, Co, Cr, Mn, Ni, Zr, Ga, Ag, Ta, Al, Au, Pb, Cu, Si, a x, y, z satisfies the following relationships: $0 \le a \le 1$, $25 \le x \le 35$, $0.5 \le y \le 3$, $0.3 \le z \le 1.5$;

the two-step diffusion method comprising the following steps:

(1) according to the main phase A with the nominal composition of $Pr/Nd_xFe_{100-x-y-z}M_y B_z$, and the main phase B with the nominal composition of $[E_aNd_{1-a}]_x Fe_{100-x-y-z}M_yB_z$, praseodymium, mischmetal (E), other metals (M), neodymium, iron, and iron boron alloy are selected and put into a crucible; after drying under vacuum and filling argon, mixed metals are smelted and then poured on a rotating water-cooled copper roller with a rotation speed of 1-4 m/s; A and B strip-casting alloys with a thickness of 180-400 μm are obtained, respectively;

(2) a PrHoFe alloy and a ZrCu alloy are prepared into PrHoFe strip-casting alloys and ZrCu strip-casting alloys using a vacuum induction rapid-quench furnace, respectively; then the PrHoFe strip-casting alloys and the ZrCu strip-casting alloys are roughly broken into square pieces with a size of (0.5-1.5) cm*(0.5-1.5) cm;

(3) the A and B strip-casting alloys of step (1) are broken by hydrogen decrepitation, respectively, and coarsely crushed powders are obtained after dehydrogenation;

(4) the hydrogen decrepitation coarse powders of the B strip-casting alloys of step (3) and the PrHoFe strip-casting alloys of step (2) are respectively placed in inner and outer cavities of a coaxial double-layer circular barrel for a first step diffusion treatment; a mass ratio of the B strip-casting alloys and the PrHoFe strip-casting alloys is 2:1 to 1:2; a molybdenum mesh separates the inner cavity and the outer cavity; first-step diffusion coarse powders are obtained by diffusion heat treatment at a speed of 1-10 r/min and 500-700° C. for 3-6 h in a rotary heat treatment furnace; an external shell of the coaxial double-layer circular barrel is made of solid material plates; a coaxial inner layer is a molybdenum mesh cylinder; an annular cavity structure between the molybdenum mesh cylinder and the external shell of the coaxial double-layer circular barrel is the outer cavity; a cavity in the molybdenum mesh cylinder is the inner cavity; a mesh diameter of the molybdenum mesh cylinder is less than 5 μm;

(5) the first-step diffusion coarse powders of step (4) and the broken ZrCu strip-casting alloys of step (2) are respectively placed in the inner and outer cavities of the coaxial double-layer circular barrel for a second-step diffusion treatment to obtain second-step diffusion coarse powders; a mass ratio of the first-step diffusion coarse powders and the broken ZrCu strip-casting alloys is 2:1 to 1:2; a diffusion heat treatment is carried out in a rotary heat treatment furnace at a speed of 1-10 r/min and 800-950° C. for 2-5 h; the rotary heat treatment furnace is connected with a glove box filled with inert gas to protect raw materials during moving in and out of the rotary heat treatment furnace in the glove box;

(6) the hydrogen decrepitation coarse powders of the A strip-casting alloys of step (3) are mixed with the second-step diffusion coarse powders after two-step diffusion treatment of step (5) to make a mass ratio of main phases A and B between 1:9 and 5:5; fine powders with a diameter of 1-5 μm are obtained by jet milling after adding 0.01-5 wt. % lubricant and 0.01-5 wt. % antioxidant; the weight percentage of the lubricant and the antioxidant is based on a total weight of the hydrogen decrepitation coarse powders of the A strip-casting alloys of step (3) and the second-step diffusion coarse powders after two-step diffusion treatment of step (5);

(7) the fine powders of step (6) adding 0.01-5 wt. % lubricant and 0.01-5 wt. % antioxidant again are mixed well, then aligned and compacted under a magnetic field of 1.5-2.0 T in an inert gas to obtain compacts; the compacts are vacuum-encapsulated and subjected to cold isostatic pressing; the weight percentage of the lubricant and the antioxidant is based on the weight of the fine powders of step (6);

(8) the compacts of step (7) are put into a vacuum sintering furnace for sintering at 980-1080° C. for 1-4 h and then cooled by argon; to restrain inter-diffusion between the two phases, the high-performance dual-main-phase sintered mischmetal-iron-boron magnet is only annealed at low temperature at 400-600° C. for 2-5 h.

2. The method for preparing high-performance dual-main-phase sintered mischmetal-iron-boron magnet by two-step diffusion according to claim 1, wherein composition and mass percentage of the PrHoFe alloy are: a mass fraction of Pr is 40-80%, a mass fraction of Ho is 10-40%, and a mass fraction of Fe is 10-20%.

3. The method for preparing high-performance dual-main-phase sintered mischmetal-iron-boron magnet by two-step diffusion according to claim 1, wherein composition and mass percentage of the ZrCu alloy are: a mass fraction of Zr is 35-65%, a mass fraction of Cu is 35-65%.

* * * * *